US010465681B2

(12) United States Patent
Hayes-Pankhurst et al.

(10) Patent No.: US 10,465,681 B2
(45) Date of Patent: Nov. 5, 2019

(54) PUMP WITH A RESILIENT SEAL

(71) Applicant: Quantex Patents Limited, London (GB)

(72) Inventors: Richard Paul Hayes-Pankhurst, London (GB); Peter William Ross, Berkshire (GB)

(73) Assignee: QUANTEX PATENTS LIMITED, London (GB)

( * ) Notice: Subject to any disclaimer, the term of this patent is extended or adjusted under 35 U.S.C. 154(b) by 672 days.

(21) Appl. No.: 14/861,492

(22) Filed: Sep. 22, 2015

(65) Prior Publication Data

US 2016/0010644 A1 Jan. 14, 2016

Related U.S. Application Data

(63) Continuation of application No. 13/265,510, filed as application No. PCT/GB2010/000798 on Apr. 21, 2010, now Pat. No. 9,175,681.

(30) Foreign Application Priority Data

Apr. 21, 2009 (GB) ..... 0906768.7

(51) Int. Cl.
*F01C 19/04* (2006.01)
*F04C 15/00* (2006.01)
(Continued)

(52) U.S. Cl.
CPC ..... *F04C 15/0015* (2013.01); *F04C 5/00* (2013.01); *F04C 15/06* (2013.01); *F05C 2225/00* (2013.01)

(58) Field of Classification Search
CPC ..... F04C 15/0015; F04C 5/00; F04B 43/1238
(Continued)

(56) References Cited

U.S. PATENT DOCUMENTS 513,315 A * 1/1894 Funk ..... F04B 43/1238 417/476
3,507,585 A * 4/1970 Mercer ..... F04B 43/0054 417/475
(Continued)

FOREIGN PATENT DOCUMENTS

EP 1813812 8/2007
GB 1182094 2/1970
(Continued)

OTHER PUBLICATIONS

International Search Report for PCT/GB2010/000798, Completed by the European Patent Office dated Feb. 16, 2011, 6 Pages.

*Primary Examiner* — Deming Wan

(57) ABSTRACT

A pump comprises a housing, with an interior defining a rotor path, an inlet formed in the housing at a first position on said rotor path, an outlet formed in the housing at a second position on said rotor path spaced from said first position. A rotor is rotatable in the housing with a first surface that seals against the housing. A second surface is formed on said rotor circumferentially spaced from said first surface and forms a chamber that travels around said rotor path to convey fluid from the inlet to the outlet. A resilient seal formed with the housing is located on the rotor path to prevent fluid flow from said outlet to said inlet past the seal. A passage may be provided to supply fluid to an under surface of the seal at a pressure that acts to urge the seal against the rotor.

10 Claims, 7 Drawing Sheets

(51) Int. Cl.

| | |
|---|---|
| ***F01C 5/04*** | (2006.01) |
| ***F04C 5/00*** | (2006.01) |
| *F04C 15/06* | (2006.01) |

(58) Field of Classification Search
USPC ..... 418/45, 21, 22, 125, 128, 129
See application file for complete search history.

(56) References Cited

U.S. PATENT DOCUMENTS

| | | | | | |
|---|---|---|---|---|---|
| 3,652,192 | A | | 3/1972 | Kramer et al. | |
| 3,771,901 | A | * | 11/1973 | Svensson | F04C 5/00 418/156 |
| 3,887,307 | A | | 6/1975 | Pratt | |
| 4,028,021 | A | | 6/1977 | Berkowitz | |
| 4,836,759 | A | | 6/1989 | Lloyd | |
| 5,006,049 | A | * | 4/1991 | von der Heyde | F04C 5/00 417/476 |
| 5,147,722 | A | | 9/1992 | Koslow | |
| 5,385,461 | A | | 1/1995 | Machida | |
| 5,465,748 | A | | 11/1995 | Bowers | |
| 5,660,536 | A | | 8/1997 | Karls et al. | |
| 7,674,100 | B2 | | 3/2010 | Hayes-Pankhurst et al. | |
| 8,152,499 | B2 | | 4/2012 | Brun et al. | |
| RE44,841 | E | | 4/2014 | Hayes-Pankhurst et al. | |
| 2005/0142019 | A1 | | 6/2005 | Lee | |
| 2007/0132131 | A1 | | 6/2007 | Tokura et al. | |
| 2009/0214369 | A1 | | 8/2009 | Brun et al. | |

FOREIGN PATENT DOCUMENTS

| | | |
|---|---|---|
| GB | 1334089 | 10/1973 |
| GB | 1583582 | 1/1981 |
| JP | 49024486 | 6/1974 |
| JP | 54139103 | 10/1979 |
| WO | 2006027548 | 3/2006 |
| WO | 2007031092 | 3/2007 |
| WO | 2008003279 | 1/2008 |

* cited by examiner

PUMP WITH A RESILIENT SEAL

CROSS-REFERENCE TO RELATED APPLICATIONS

This application is a continuation of U.S. application Ser. No. 13/265,510 filed Oct. 20, 2011, which, in turn, is the U.S. national phase of PCT Appln. No. PCT/GB2010/000798 filed Apr. 21, 2010, which claims priority to Great Britain application GB 0906768.7 filed Apr. 21, 2009, the disclosures of which are incorporated in their entirety by reference herein.

TECHNICAL FIELD

The invention relates to pumps.

BACKGROUND

A known form of pump comprises a housing with an inlet for connection to a source of fluid and an outlet for pumped fluid with the inlet and the outlet being spaced apart around a path of a rotor within the housing. The rotor includes at least one surface forming, with the housing, a closed chamber travelling around the housing to convey fluid around the housing. In this specification, the term "fluid" includes both gases and liquids.

A pump of this kind is disclosed in WO 2006/027548 in which a seal is provided in the housing between the inlet and the outlet to seal against the rotor. A first problem with pumps of this kind is that the housing and the seal are formed separately and then fitted together. As described in WO 2006/027548, the housing may be injection moulded and the seal fixed in the housing using an adhesive. Alternatively, the seal may be moulded with the housing in a 2-shot injection moulding process. This is a problem when there are two or more chambers because, any mismatch at the join between the housing and the seal can cause a leakage between adjacent chambers, particularly at higher pressure differences between the inlet pressure and the outlet pressure and where the apices of the rotor are positioned pressing into the seal. This leakage causes inaccuracy of flow rate of the pump and may allow unwanted backflow through the pump when stopped or at low flow rates.

According to a first aspect of the invention, there is provided a pump comprising a housing, the housing having an interior defining a rotor path, an inlet formed in the housing at a first position on said rotor path, an outlet formed in the housing at a second position on said rotor path spaced from said first position, a rotor rotatable in said housing, at least one first surface formed on the rotor and sealing against said rotor path of the housing, at least one second surface formed on said rotor circumferentially spaced from said first surface and forming a chamber with the rotor path that travels around said rotor path on rotation of the rotor to convey fluid around the housing from the inlet to the outlet, a resilient seal formed in one piece with the housing, located on said rotor path and so extending between the outlet and the inlet in the direction of rotation of said rotor that the first rotor surface seals with, and resiliently deforms, the seal, as the rotor rotates around the rotor path within the housing to prevent fluid flow from said outlet to said inlet past the seal.

A further problem with such a pump arises if there is a mismatch between, first, the force required to form a seal between the rotor and the housing and, secondly, the pressure of the fluid at either the inlet or the outlet. At higher pressures, a greater sealing force is required but, if such a higher force is used at lower pressures, then frictional forces are unnecessarily increased and the torque required to drive the rotor is unnecessarily high. If a lower sealing force is used at higher pressures, then there can be leakage between the seal and the rotor and higher outlet pressures cannot be achieved.

According to a second aspect of the invention, there is provided a pump comprising a housing, the housing having an interior defining a rotor path, an inlet formed in the housing at a first position on said rotor path, an outlet formed in the housing at a second position on said rotor path spaced from said first position, a rotor rotatable in said housing, at least one first surface formed on the rotor and sealing against said rotor path of the housing, at least one second surface formed on said rotor circumferentially spaced from said first surface and forming a chamber with the rotor that travels around said rotor path on rotation of the rotor to convey fluid around the housing from the inlet to the outlet, a resilient seal located on said rotor path and so extending between the outlet and the inlet in the direction of rotation of said rotor that the rotor surface seals with, and resiliently deforms, the seal, as the rotor rotates around the rotor path within the housing to prevent fluid flow from said outlet to said inlet past the seal, the seal having an under surface opposed to a surface of the seal contacted by the rotor, a passage being provided to supply said fluid to said under surface at a pressure that acts to urge the seal against the rotor.

In WO2006/027548, the rotor is provided with one or more chambers with each chamber having a circumferential length that is shorter than the circumferential distance between the inlet port and the outlet port. This limits the volume of fluid that can be pumped.

According to a third aspect of the invention, there is provided a pump comprising a housing, the housing having an interior defining a rotor path, an inlet formed in the housing at a first position on said rotor path, an outlet formed in the housing at a second position on said rotor path spaced from said first position, a rotor rotatable in said housing, one first surface formed on the rotor and sealing against said rotor path of the housing, said first surface having a circumferential length longer than the circumferential length between the inlet and the outlet, a single second surface formed on said rotor circumferentially spaced from said-first surface, having a circumferential length longer than the circumferential length between the inlet and the outlet and forming a chamber with the housing travelling around said rotor path on rotation of the rotor to convey fluid around the housing from the inlet to the outlet, a resilient seal located on said rotor path and so extending between the outlet and the inlet in the direction of rotation of said rotor that the first surface and the single second surface seal with, and resiliently deform, the seal, as the rotor rotates around the rotor path within the housing to prevent fluid flow from said outlet to said inlet past the seal.

In pumps of this kind, the rotor and the chamber of the housing have a generally cylindrical shape with the cylinder of the rotor fitting into and rotating within the cylindrical chamber. The required tightness of fit between the parts is determined during manufacture and is difficult to adjust during assembly or in use.

According to a fourth aspect of the invention, there is provided a pump comprising a housing, a rotor path defined by the housing and within the housing, an inlet formed in the housing at a first position on said rotor path, an outlet formed in the housing at a second position on said rotor path spaced from said first position, a rotor rotatable in said housing, at least one first surface formed on the rotor and sealing against said rotor path of the housing, at least one second surface formed on said rotor circumferentially spaced from said first surface and forming a chamber with the rotor path that travels around said rotor path on rotation of the rotor to convey fluid around the housing from the inlet to the outlet, a resilient seal located on said rotor path and so extending between the outlet and the inlet in the direction of rotation of said rotor that the rotor surface seals with, and resiliently deforms, the seal, as the rotor rotates around the rotor path within the housing to prevent fluid flow from said outlet to said inlet past the seal, the rotor path being frustoconical and the first surface of the rotor being frustoconical and being a mating fit with the rotor path.

In this case, the relative positions of the rotor and the housing may be axially adjustable.

BRIEF DESCRIPTION OF THE DRAWINGS

The following is a more detailed description of some embodiments of the invention, by way of example, reference being made to the accompanying drawings, in which.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
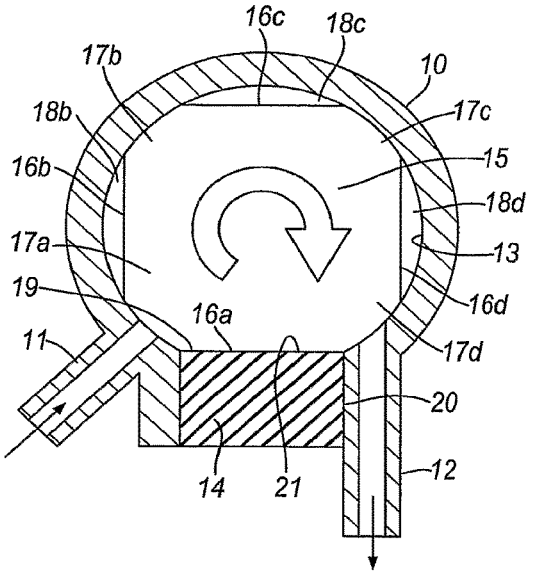
FIG. 1 is a schematic cross-section through a known pump as disclosed in WO 2006/027548 including a housing provided with an inlet and outlet and a rotor rotatable within the housing and sealing against a seal provided by the housing, the rotor being shown in a first angular position.
Figure 2:
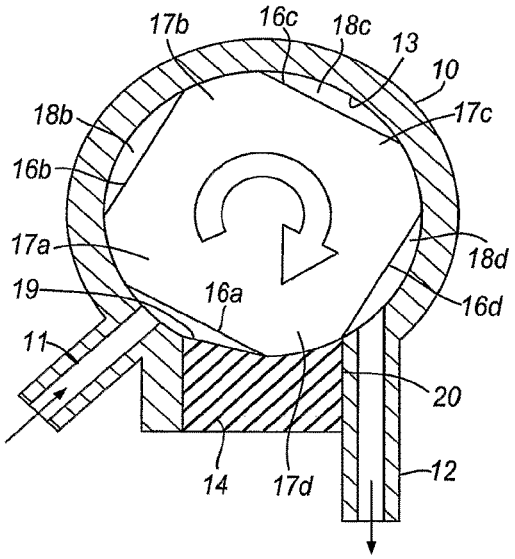
FIG. 2 is a similar view to FIG. 1 but showing the rotor of the known pump rotated by about 30° from the position shown in FIG. 1.
Figure 3:
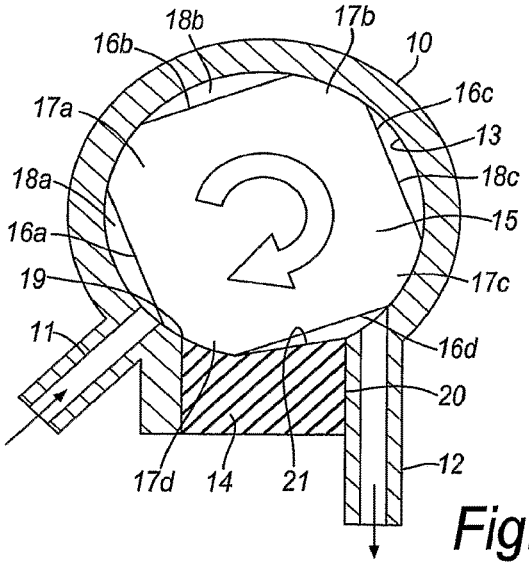
FIG. 3 is a similar view to FIG. 1 but showing the rotor of the known pump rotated by about 60° from the position shown in FIG. 1.

Referring first to FIGS. 1 to 3, the known pump of WO 2006/027548 is formed by a housing indicated generally at 10 which may be formed by a plastics moulding of, for example, polyethylene or polypropylene. The housing 10 is formed with an inlet 11 for connection to a source of fluid and an outlet 12 for pumped fluid. The interior of the housing 10 is cylindrical. The portion of the interior of the housing 10 between the outlet 12 and the inlet 11, again in clockwise direction as viewed in FIGS. 1 to 3, carries a seal 14 that will be described in more detail below.

The housing 10 contains a rotor 15. The rotor 15 may be formed of a metal such as stainless steel or as a precision injection moulded plastics part formed from a resin such as acetal. As seen in the Figures, the rotor 15 is generally-of circular-cross-section and includes four recessed surfaces 16*a*, 16*b*, 16*c* and 16*d* of equal length equiangularly spaced around the rotor and interconnected by apices 17*a*, 17*b*, 17*c* and 17*d* formed by unrelieved portions of the rotor 15. Accordingly, each apex is rounded with a curvature that matches the curvature of the cylindrical housing surface 13 so that the rotor 15 is a close fit within the cylindrical housing surface 13 that forms a rotor path for the rotor. As a result, each recessed surface 16*a*, 16*b*, 16*c* and 16*d* forms a respective chamber 18*a*, 18*b*, 18*c* and 18*d* with the cylindrical housing surface 13 as each surface 16*a*, 16*b*, 16*c*, 16*d* travels around that rotor path 13. If the housing 10 is formed from a resilient plastics material that deforms under load, the rotor 15 may be arranged to distend slightly the housing 10, so ensuring a fluid-tight seal around each surface 16*a*, 16*b*. 16*c*. 16*d*.

The rotor 15 is rotated in a cloclca4se direction in FIGS. 1 to 3 by a drive (not shown in the Figures).

The seal 14 is formed by a block of elastomeric material that is compliant, flexible and resilient such as that sold under the trade mark Hytrel. The seal 14 is connected to the housing 10 to prevent fluid passing between the seal 14 and the housing 10. This may be by use of an adhesive. Alternatively, the seal 14 could be moulded with the housing 10 in a 2-shot injection moulding process. In this latter case, the material of the seal 14 must be such that it welds to the housing to prevent leakage. The seal 14 has a first axial edge 19 adjacent the inlet 11 and a second axial edge 20 adjacent the outlet 12. The seal 14 has a rotor engaging surface 21 that has a length between the first and second edges 19, 20 that is generally equal to the length of each of the recessed surfaces 16*a*, 16*b*, 16*c* and 16*d* between the associated apices 17*a*, 17*b*, 17*c*, 17*d* and is shaped to match the shape of each recessed surface 16*a*, 16*b*, 16*c*, 16*d*. The axial extent of the seal 14 is that at least the same as the axial extent of the recessed surfaces 16*a*, 16*b*, 16*c*, 16*d*. The seal 14 projects into the space defined by an imaginary cylinder described by a continuation of the cylindrical surface 13 between the inlet 11 and the outlet 12. The seal 14 may be flexed between the first and second axial edges 19, 20 so that it bows outwardly relatively to the seal 14 towards the axis of the rotor 15 where the recessed surfaces 16*a*, 16*b*, 16*c*, 16*d* are concave.

The natural resilience of the material will tend to return the seal 14 to the undistorted disposition after distortion by the rotor 15 and this may be assisted by a spring (not shown) acting on the outer end of the seal 14.

The operation of the known pump described above with reference to FIGS. 1 to 3 will now be described. The inlet 11 is connected to a source of fluid to be pumped and the outlet 12 is connected to a destination for the pumped fluid. The rotor 15 is rotated in a clockwise direction as viewed in FIGS. 1 to 3. In the position shown in FIG. 1, the rotor surface 16*a* engages resiliently the seal surface 21. In this way, the space between the housing 10 and the rotor 15 is closed in this zone mad the passage of fluid from the outlet 12 to the inlet 11 is prevented. In this position, the apex 17*a* is aligned with the inlet 11 while the rotor surfaces 16*b*, 16*c*, 16*d* form respective sealed chambers 18*b*, 18*c*, 18*d* with the cylindrical housing surface 13. As a result of earlier revolutions of the rotor 15, these chambers 18*b*, 18*c* and 18*d* are filled with fluid in a manner to be described below.

Referring next to FIG. 2, on rotation of the rotor 15 by about 30°, the chamber 18*d* is now connected to the outlet 12. The associated apex 17*d* contacts the seal surface 21 and seals against that surface. Accordingly, the rotating rotor 15 forces fluid from the chamber 18*d* out of the outlet 12. In addition, the apex 17*a* previously aligned with the inlet 11, moves away from the inlet 11 and allows the rotor surface 16*a* to separate from the sealed surface 21 to begin to form a chamber 18*a* (FIG. 3) with the cylindrical housing surface 13- and with the apex 17*d* against the seal surface 21.

Referring next to FIG. 3, a further rotation of the rotor 15 by about 60° from the position shown in FIG. 1, results in the rotor surface 16*d* that previously formed the chamber 18*d* adjacent with outlet 12 begins to contact the seal surface 21 and sealing against that surface 21. Thus, the chamber 18*d* reduces in volume until zero and fluid from that chamber is forced through the outlet 12. At the same time, the rotor surface 16*a* formerly in contact with the seal surface 21 is now clear of that surface 21 and forms a chamber 18*a* with the cylindrical housing surface 13 and the chamber 18*a* receives fluid from the inlet 11. The apex 17*d* between the surfaces 16*a* and 16*d* moves out of engagement with the seal surface 21 and starts to align with the inlet 11.

The rotor 15 then moves to a position equivalent to the position shown in FIG. 1 and pumping continues. In this way, fluid is pumped between the inlet 11 and the outlet 12.

It will be appreciated that the rate of flow of liquid is proportional to the rate of rotation of the rotor 15 and the volumes of the chambers 18*a*, 18*b*, 18*c* and 18*d*. Although the rotor 15 is shown as having four surfaces 16*a*, 16*b*, 16*c*, 16*d*, it could have any number of surfaces such as one or two or three surfaces or more than four surfaces. The surfaces 16*a*, 16*b*, 16*c*, 16*d* may be planar, or may be, for example, convexly o1" concavely curved. They may be shaped as indentations formed by the intersection with the rotor 15 of an imaginary cylinder having its axis at 90° to the axis of the rotor and offset to one side of the rotor axis. As described above, the rotor engaging surface 21 of the seal 14 may be shaped to complement the shape of the surfaces 16*a*, 16*b*, 16*c*, 16*d*.

At all times, the seal-14 acts to prevent the formation of a chamber between the outlet 12 and the inlet 11 in the direction of the rotor 15. The resilience of the seal 14 allows it always to fill the space between the inlet 11 and the outlet 12 and the portion of the rotor 15 in this region. As the pressure differential between the inlet 11 or the outlet 12 increases, there is an increased tendency for fluid to pass between the seal 14 and the rotor 15. The use of a spring acting on the seal 14, as described above, will decrease that tendency and so allow the pump to operate at higher pressures. Thus, the force applied by the spring determines the maximum pump pressure. Pumps are known in which the outlet and the inlet are separated by a thin vane extending from the housing and contacting the rotor. In such pumps, there is a volume of fluid between the outlet and the inlet and a large pressure gradient across the vane that will increase as the speed of rotation of the rotor if it is driving the fluid through a fixed outlet and the viscosity of the fluid leads to a back pressure that rises with flow rate. As a result, there is an increased liability to leakage across the vane. In the pump described above with reference to the drawings, although there is a pressure differential between the inlet and the outlet, there is a smaller pressure gradient across the barrier between the inlet 11 and the outlet 12 as the fluid is gradually squeezed out of the chambers 18*a*, 18*b*, 18*c* and 18*d* into the outlet 12 and then, after further rotation of the rotor 15, gradually introduced into a chamber 18*a*, 18*b*, 18*c* and 18*d* on the inlet side. This reduces the possibility of leakage and allows the pump to provide an accurate metered flow. The seal 14 acts as a displacer displacing the fluid between the inlet 11 and the outlet 12.

All that is described above with reference to FIGS. 1 to 3 is disclosed in WO 2006/027548.

Figure 4:
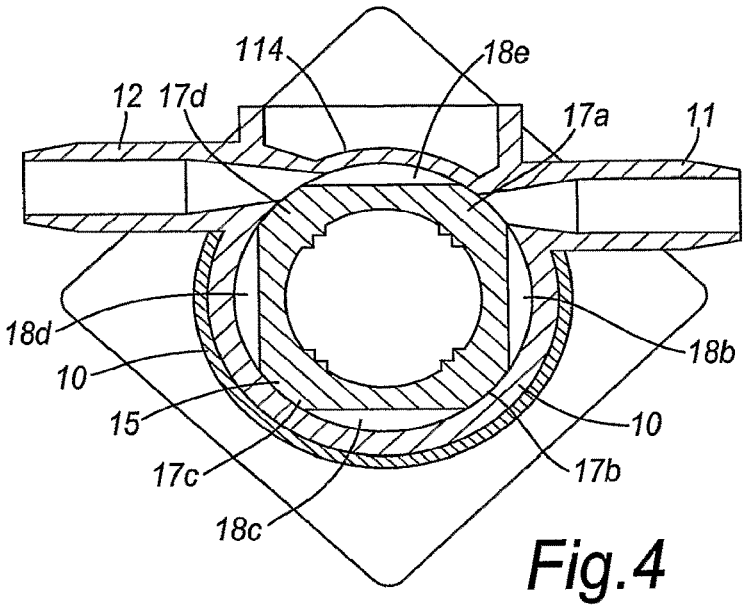
FIG. 4 is a schematic cross-section through a pump according to the invention including a housing provided with an inlet and outlet and a rotor rotatable within the housing and sealing against a seal formed in one piece with the housing.

Referring next to FIG. 4, parts common to FIGS. 1 to 3 and to FIG. 4 will be given the same reference numerals and will not be described in detail.

In the embodiment of FIG. 4, the separate seal 14 is omitted. A seal 114 is formed in one-piece with the housing 10. These parts may be formed from a plastics material by a single injection moulding process. The seal 114 is a thin plastics wall that extends circumferentially from the inlet 11 to the outlet 12. The thickness of the wall may, for example, be 0.15 mm. The material of the housing 10 and the thickness of the wall are chosen such that the wall can distort when contacted by the apices 17*a*, 17*b*, 17*c*, 17*d* of the rotor 15. Suitable materials may be polyethylene or polypropylene.

In order for the seal 114 to be flexible enough to follow the contour of the rotor 15 as it rotates requires that the seal 114 be moulded with a very thin wall section. This requirement for a thin wall section over a large area is not normally encountered in typical injection moulded parts. By careful processing using high injection pressures, locally hot tooling around the seal area and local venting to eliminate gassing it is possible to achieve seals 114 with a wall thickness between 0.1 mm-0.3 mm.

In a preferred process, the sliding portion of the tool that creates the outer surface of the seal 114 is controlled hydraulically. The molten plastic is injected into the tool by the injection screw in the conventional manner where the seal wall thickness is approximately twice the design thickness thus allowing the molten material to flow readily across the seal. Instead of using the injection screw to provide the packing pressure whilst the moulding cools and solidifies the sliding portion of the tool is advanced hydraulically to create the desired seal wall thickness and creating the packing pressure at the same time.

The use of a suitable flexible material for the seal 114 may require the moulding of stiffening members such as flanges on the housing 10 to provide it with sufficient rigidity.

In use, the presence of the unitarily formed seal 114 ensures that there is no leakage between adjacent chambers 18*a*, 18*b*, 18*c* and 18*d* at the joint between the housing 10 and the seal 114 as an apex 17*a*, 17*b*, 17*c*, 17*d* passes the joint, as may occur in the known embodiment of FIGS. 1 to 3 particularly at higher pressures. The use of a single shot moulding compared with twin shot or co-moulding processes, reduces the number of processes, has a faster cycle time, requires simpler mould tools and mould machinery and leads to higher manufacturing yield and lower production costs. In comparison with pumps of this kind omitting these features, the pump of FIG. 4 may have a longer operational life.

Figure 5:
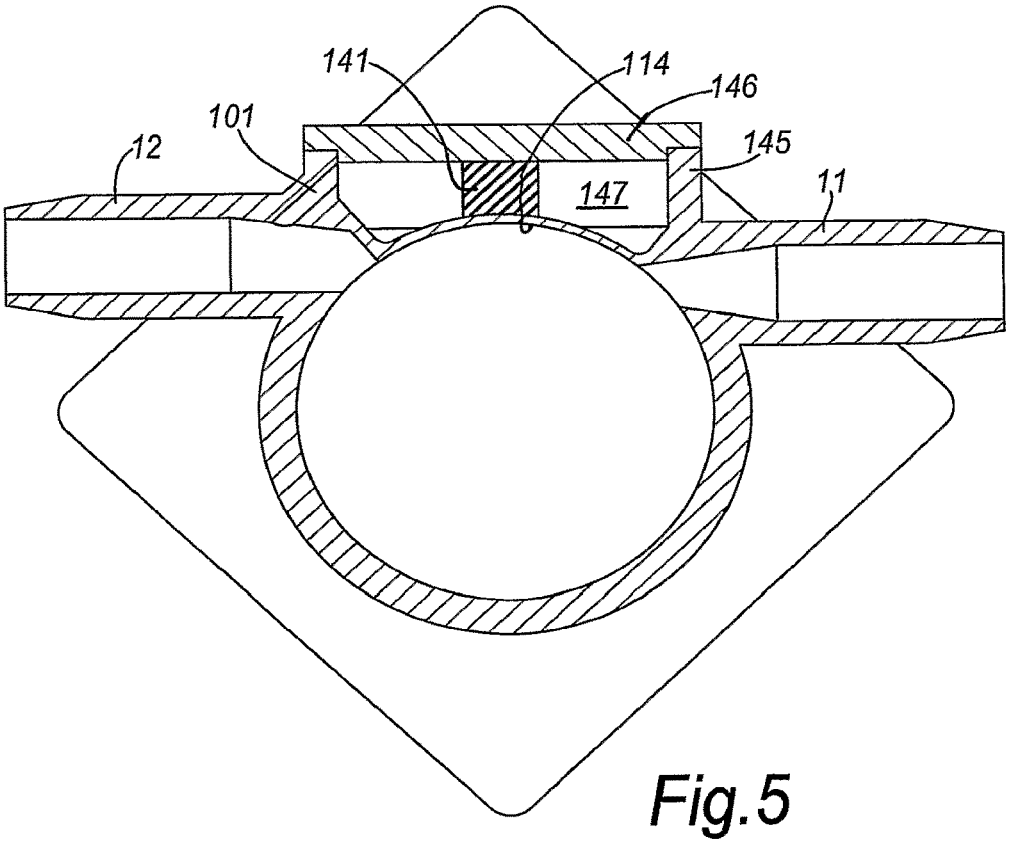
FIG. 5 is a similar view to FIG. 4 but showing a modified form of the pump in which a port is provided leading from a point adjacent the outlet to behind the seal.

Referring next to FIG. 5, parts common to FIGS. 1 to 4 and to FIG. 5 will be given the same reference numerals and will not be described in detail.

In the embodiment of FIG. 5, the seal 114 is formed in one piece with the housing 10, as in FIG. 4. In this embodiment, however, there is provided a resilient displacer pad 141 that bears against the underside of the seal 114 to urge the seal against the rotor 10. This allows the pump to be used at higher pressures since the additional pressure from the pad 141 resists the forced passage of fluid between the rotor 10 and the seal 114. The force applied by the pad 141 is chosen to allow the pump to operate at a lower end of a range of operating pressures for which the pump is designed, for example up to 0.5 bar.

In addition, a port 101 is provided in the outlet 12 to allow communication between the outlet 12 and the space behind the seal 114. The effect of this is to allow fluid to flow through the port 101 in operation and apply fluid pressure to a chamber 147 formed by the under surface of the seal 14, a turret 145 projecting outwardly from the rest of the housing 10 and a cap 146 closing the turret 145. The force applied by the seal 114 to the rotor is thus the sum of the force applied by the pad 141 and the force applied by the fluid. In this way, the applied force varies with the outlet pressure and an increase in outlet pressure results in a corresponding increase in the force applied to the seal 114 so preventing leakage between the seal 114 and the rotor 10 as a result of the increased pressure.

It has been found that pumps that have a maximum operating pressure of 1 bar without the port 101 can be operated at pressures of up to and exceeding 6 bar with the port 101. As the pressure applied to the seal 114 varies automatically with output pressure, a single design of pump incorporating such a port 101 may be used for a variety of applications requiring a wide range of pressures. In addition, the pump always operates with the minimum torque requirement since the force between the seal 114 and the rotor 10 is never unnecessarily high.

Since the pad 141 bears against the under surface of the seal 114, it advisable to make the pad 141 sufficiently resilient that pressure from the outlet 12 is transmitted to the seal 114.

The fluid could be provided to the under surface from the inlet 11 or from any other suitable point within the housing 10 or supplied via a tube from a remote location in the fluid system, thus enabling the manufacture of a pump with high input pressure or output pressure.

Figure 6:
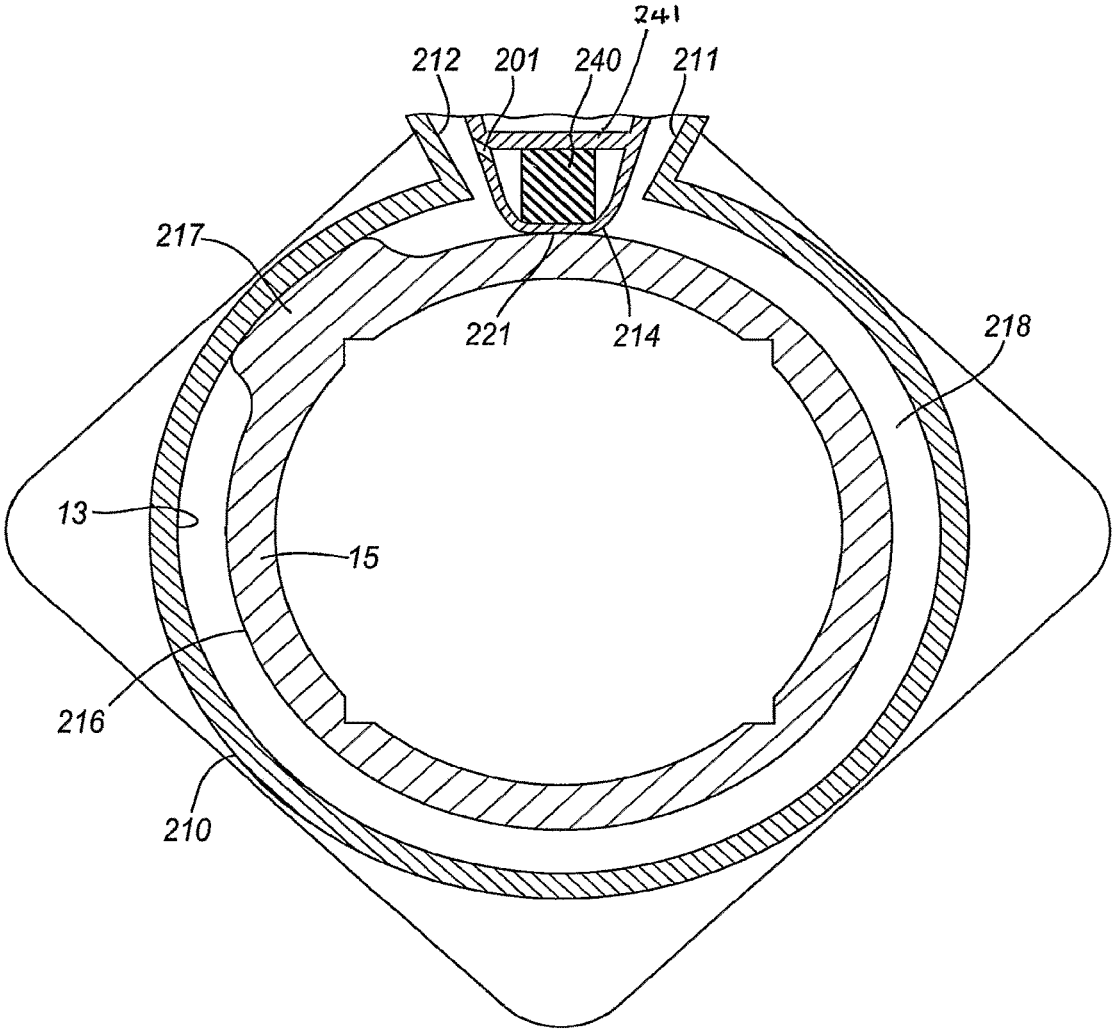
FIG. 6 is a similar view to FIGS. 1 to 3 and showing a pump according to the invention including a rotor provided with a single chamber.

Referring next to FIG. 6, parts common to FIGS. 1 to 3 and to FIG. 6 will be given the same reference numerals and will not be described in detail. In FIG. 6, the housing 210 is moulded in one-piece as described above with reference to FIG. 4. The housing 210 has an inlet 211 and an outlet 212 that a closely spaced in a circumferential direction. A seal 214 is formed in one-piece with the remainder of the housing 210 as described above with reference to FIG. 4 and is urged radially inwardly by a resilient pad 240 acting between seal 214 and a base 241 formed on the housing. The space containing the pad 240 is connected to the outlet 212 by a port 201 formed between the seal 214 and the housing 210. This port 201 operates as described above with reference to FIG. 5.

The rotor 15 is provided with a single recessed surface 216 with the ends of this surface 216 interconnected by a single apex 217 extending axially along the rotor 15. The circumferential length of the apex 217 is longer than the circumferential spacing of the inlet 211 and the outlet 212.

The seal 214 has a radially inwardly projecting rotor engaging surface 221 urged by the pad 240 into contact with the surface of the recessed portion 216, as the portion 216 passes over the seal 214.

The pump of FIG. 6 operates generally as descried above with reference to FIGS. 1 to 5. Since, however, the circumferential length of the recessed surface 216 is greater than the circumferential spacing of the inlet 211 and the outlet 212, the contact between and the surface 216, as the surface 216 passes over the seal 214, prevents communication between the inlet and outlet ports 211, 212.

The benefit of the pump of FIG. 6 is that the single chamber 218 formed between the recessed surface 216 and the chamber 13 maximises the volume of fluid transferred from the inlet 211 to the outlet 212 on each rotation of the rotor 15. This is further improved by the decrease in the circumferential separation of the inlet 211 and the outlet 212, so allowing the circumferential extent of the apex 217 to be reduced and the circumferential extent of the recessed surface 216 to be correspondingly increased, so increasing the volume of the chamber 218.

Of course, the pump of FIG. 6 could have a separate seal, as described above with reference to FIGS. 1 to 4. In addition, the port 201 is optional. In addition, in the embodiments of both FIGS. 5 and 5, the ports 101 and 201 are shown as leading from the outlet 12, 212 to the under surface of the seal 114, 214, It is possible, as an alternative, for the ports to lead from the associated inlet 11, 211 to the under surface of the seal 114, 214.

In the embodiments described above with reference to FIGS. 1 to 6, the interior of the housing 10 and the exterior of the rotor 15 have complementary cylindrical surfaces. The operating torque and the maximum pumping pressure are affected by the closeness of the fit between these parts and small manufacturing variations can have an adverse effect by increasing the required torque and by reducing the maximum pumping pressure through leakage.

Figure 7:
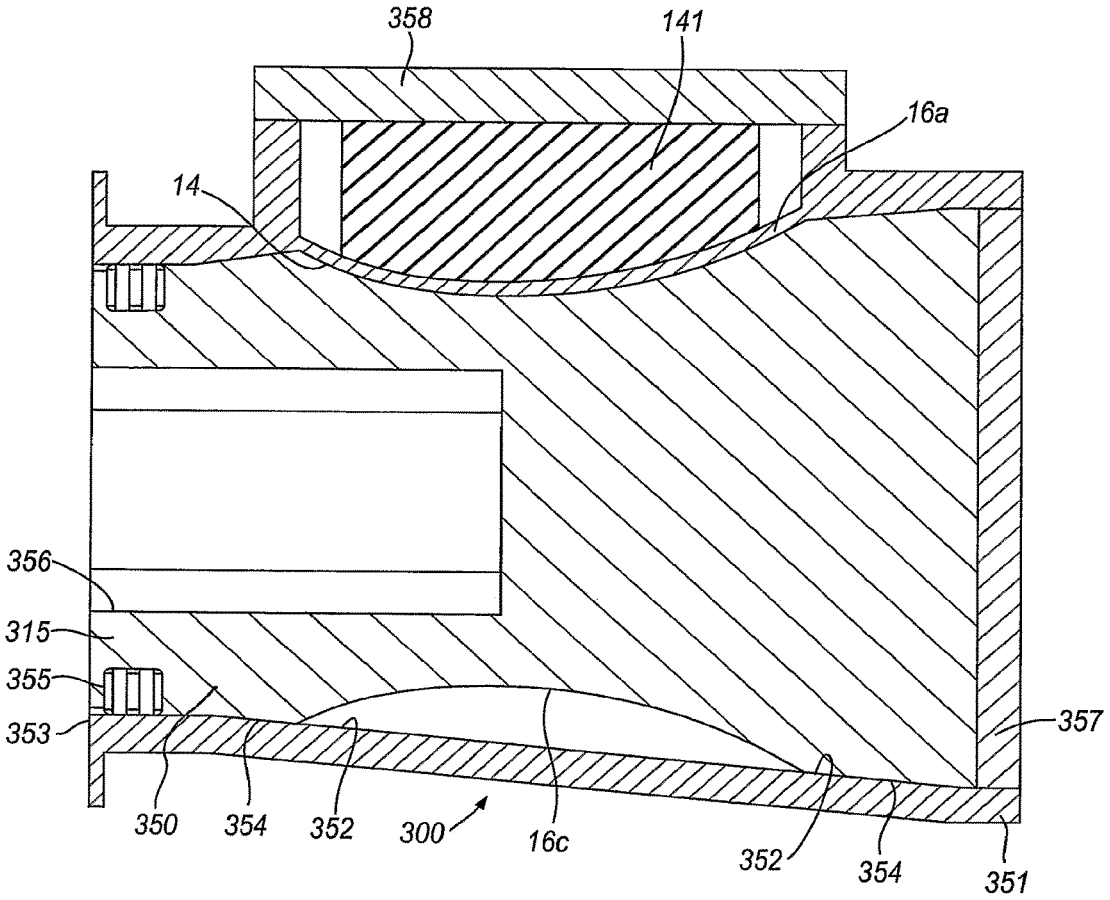
FIG. 7 is a longitudinal cross-section through a pump of the general kind shown in FIGS. 1 to 3 but with a rotor and housing having a frusto-conical shape.

Referring next to FIG. 7, parts common to the pump of FIGS. 1 to 3 and to the pump of FIG. 7 will be given the same reference numerals and will not be described in detail.

In the pump of FIG. 7, the housing 300 has an interior that has a first short smaller diameter cylindrical end 350 and a second short larger diameter end 351 inter-connected by a frusto-conical section 352. The rotor 315 has a short smaller diameter cylindrical end 353 with the body of the rotor 354 being frusto-conical so that the rotor 315 fits in, and is rotatable in, the interior of the housing 300 with the rotor body 354 mating with the frusto-conical section 352 of the housing 300. The smaller diameter end 353 of the rotor 315 carries an annular seal 355 that seals between the rotor 315 and the housing 300. The seal may be an O-ring, a quad seal or a lip seal and may be moulded in either the housing 300 or the rotor 315

The included cone angle of the frusto-conical section 352 of the housing 300 and of the rotor body 354 may be between 2° and 20° and may preferably be between 5° and 15° more preferably 10°

The larger diameter end 350 of the housing 300 carries a washer 357 that can be adjusted to move the rotor 315 axially relative to the housing 300 to adjust the fit between these parts and to obtain the required interface pressure between the rotor 315 and the housing 300 while minimising the torque required to rotate the rotor 315 via a drive socket 356 extending axially into the smaller diameter end 353 of the rotor 350. This thus mitigates the potential problem with manufacturing variations affecting the fit between a cylindrical housing interior and mating rotor surface. The contact point between the washer 357 and the rotor 315 may be made preferentially near the axis of the rotor 315 to reduce the torque required to rotate the rotor 315.

As seen in FIG. 7, rotor 350 is provided with recessed surfaces, two of which 16*a*, 16*c* as seen in FIG. 7. In addition, the housing 300 is provided with a seal 14 that may be formed in any of the ways described herein with reference to the drawings. A pad 141 may be provided as described above with reference to FIG. 5 and held in place by a cap 358.

The pressure urging the rotor 350 against the housing can be carefully controlled so that the interface pressure between the housing and the contact surfaces is set to a desired value. This pressure can be provided in any of the following ways (which may be used individually or in any combination). Firstly, the pressure could be provided by a spring acting on the rotor 350. Secondly, the pressure could be provided by modifying the rotor 350 to crate a flange or lugs during manufacture so that it is held by the smaller diameter end of the housing 300 at the appropriate position. Thirdly, the pressure could be provided by modifying the larger diameter end of the housing 300 to hold the rotor 350 at the appropriate axial position. The modification can be achieved by heating treating the end of the housing 300 and producing a lip around the circumference ("heat staking") or by welding a washer to the housing 300 to form a rim or by moulding a deformable lip on the housing 300 over which the rotor 315 snaps into place.

Figure 8:
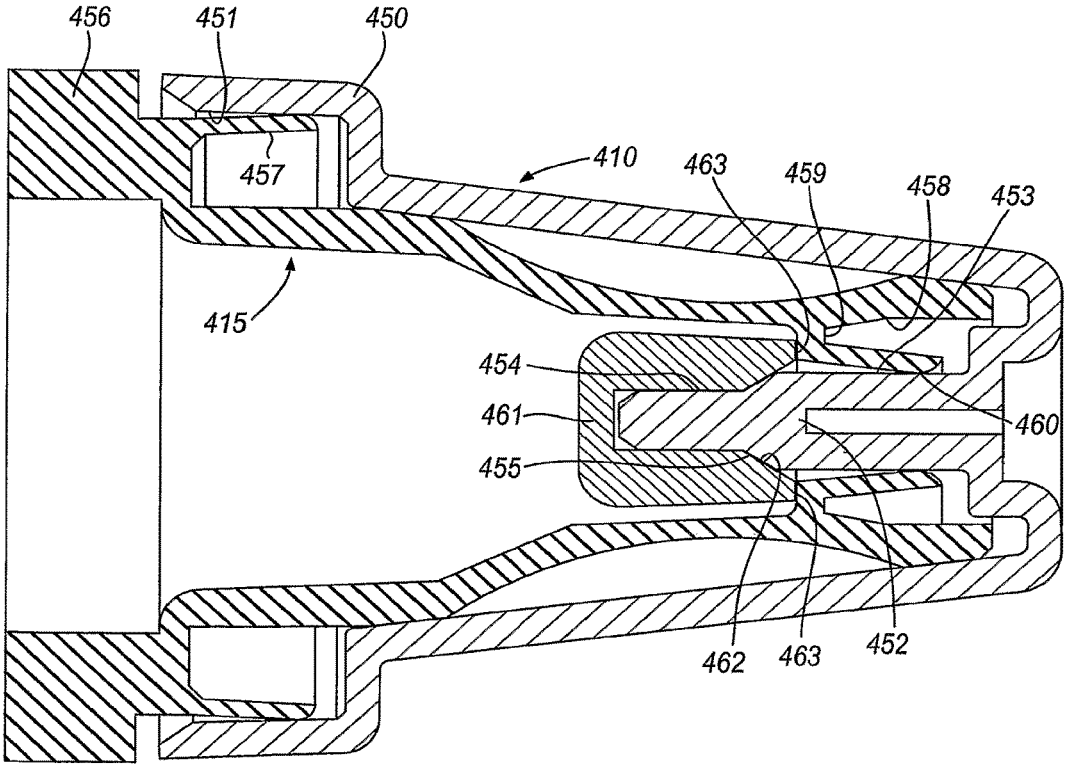
FIG. 8 is a longitudinal cross-section of a pump of the general kind shown in FIG. 7 but with a second form of frusto-conical rotor and housing.

Referring next to FIG. 8, in this embodiment, the housing 410 contains a rotor 415 with the housing 410 and the rotor 415 having mating frusto-conical surfaces, as described above with reference to FIG. 7. In this embodiment, the housing 410 is formed at a larger diameter end with an L-section annular flange 450 having a cylindrical inner surface 451 co-axial with the axis of the housing 410. At a smaller diameter end of the rotor 410, there is formed inwardly projecting hub 452 provided with a larger diameter outer cylindrical surface 453 connected to a smaller diameter outer cylindrical surface 454 by an angled annular step 455.

The rotor 415 is of hollow cylindrical shape and is received within the housing 410. The rotor 415 is formed at its larger diameter end with a radially outwardly directed flange 456 carrying an axially projecting annular seat 457 that bears against the inner surface 451 of the annular flange 450 of the housing 410 to form a seal between the parts. At the smaller diameter end of the rotor 415, an inner surface 451 of the rotor 415 is formed with an annular L-section seal 459 having a lip 460 that bears against the larger diameter outer cylindrical surface 453 of the hub 452 to form a seal between the parts.

A spline is formed on the inner surface of the flange 456 to transmit drive to the rotor 415. Alternatively, gear teeth can be formed to the outer surface of the flange 456 to transmit drive to the rotor.

A cap 461 has a beveled end surface 462 and fits over the smaller diameter outer cylindrical surface 454 of the hub 452 with the beveled end surface 462 bearing against the step 455 and the open end 463 of the cap 461 bearing against L-section seal 459 on the smaller diameter end of the rotor 415. The cap 461 is fixed to the hub 452 by, for example, welding.

This engagement positions the rotor 415 axially relatively to the housing 410. It will be appreciated that by varying the dimensions and/or position of the cap 461, the axial position of the rotor 415 relative to the housing may be so varied as to provide a required interface pressure between the rotor 415 and the housing 410.

The pump of FIG. 8 has an inlet and an outlet (not shown) and a seal (not shown) and otherwise operates as described above with reference to FIGS. 1 to 7.

The pump 10 need not be made from a metal such as stainless steel or a resin such as acetal, the rotor 15 could be made from, for example, polyethylene or polypropylene.

The seal 14 need not have a shape to match the shape of each recessed surface 16*a*, 16*b*, 16*c*, and 16*d*. The seal 14 may, for example have a natural shape that is a continuation of the cylindrical surface of the housing 10 with a spring or resilient pad acting to distort the seal 14 towards the axis of the rotor 15. In practice the seal is formed to the same radius of curvature as the diameter of the cylindrical housing 10, but in general it can be moulded to curved shapes which cross the cylindrical volume provided that the join between the housing and the seal is tangential to the cylinder defined by the interior of housing.

The rotor 15 may also be driven in the anti-clockwise direction and the direction of flow will reverse. Where the ports 11 and 12 are placed symmetrically with respect to the seal 14, the pump will provide the same flow characteristic in both directions. In practice it is found that higher output pressures can be obtained with the output port moved circumferentially slightly away from the seal 14 as this reduces the tendency for fluid to travel back between the seal 14 and the rotor 15 when the apices 17*a*, 17*b*, 17*c*, 17*d* are close to the output port. In this case the flow rate in the anti-clockwise direction is lower due to the seal 14 not being as effective at displacing the fluid from the chamber.

Figure 9:
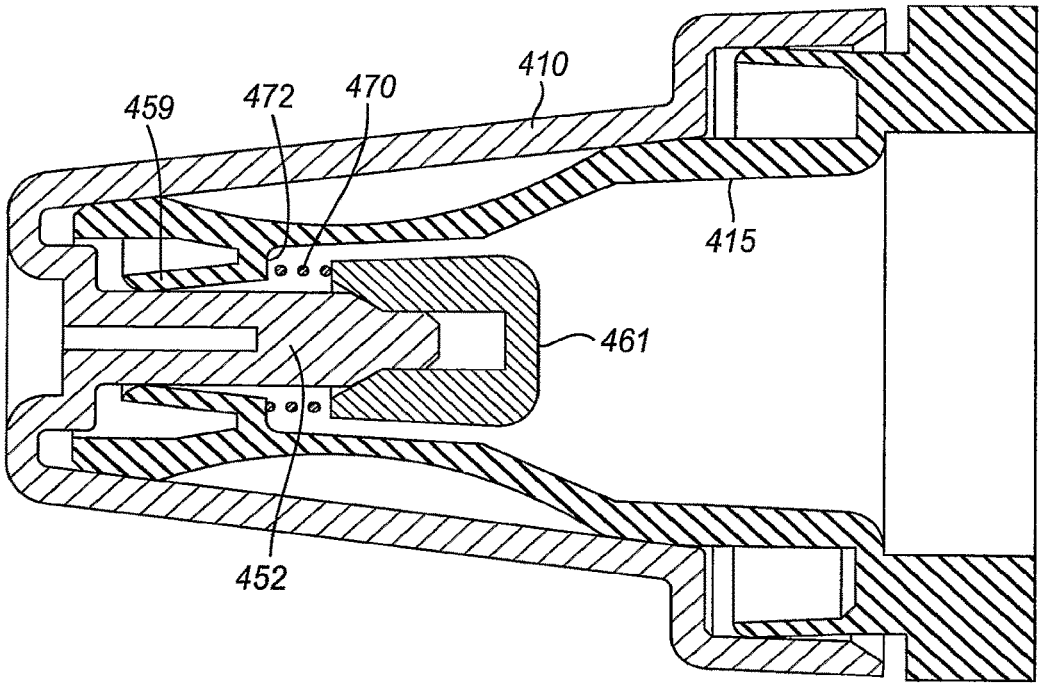
FIG. 9 is a similar view to FIG. 8 but showing the provision of a spring to allow axial adjustment of the position of the rotor relative to the housing.

Referring next to FIG. 9, parts common to FIG. 8 and to FIG. 9 will be given the same reference numerals and will not be described in detail.

In the pump of FIG. 8, the position of the cap 461 determines the interface pressure between the rotor 415 and the housing 410. As described with reference to FIG. 8, this force can be adjusted by varying the position and/or the dimensions of the cap 461.

This adjustment may be required to allow the pump to be used with fluids of differing viscosities or with adverse rheological properties such as shear thickening. For lower viscosity fluids, for example, a smaller gap between rotor 415 and the housing 410 is possible without unduly increasing the torque required to turn the rotor 415. With higher viscosity fluids such as paint or food sauces, it is advantageous to increase this gap in the bearing area to reduce the torque required to rate the rotor 415. Such an increased gap does not lead to leakage of fluid or affect output pressure or accuracy of flow rate but such a larger gap can affect the self-priming ability of the pump (where the pump and its supply lines are empty of fluid at the start of operation).

The embodiment of FIG. 9 addresses this problem by the provision of a spring 470 located around the hub 452 and acting between the cap 461 and a radially extending annular wall 472 of the seal 459. The effect of the spring 470 is to urge the rotor 415 against the housing 410 and so close the gap between these parts when the pump is empty of fluid. This allows gas to be pumped through the pump when the pump is priming so allowing higher viscosity fluids to be drawn into the pump to prime the system. When such a higher viscosity fluid reaches the pump outlet, the increased outlet pressure and the thin film of liquid that forms between the mating surfaces between the rotor and the housing act on the rotor 415 to force it away from the housing 410 by compressing the spring 470, so increasing the gap between the rotor 415 and the housing 410. Thus, the axial position of the rotor 415 relative to the housing 410 is adjusted in accordance with the pressure of the fluid being pumped to increase the spacing between the rotor 415 and the housing 410 with increasing fluid pressure in the pump The spacing between the cap 461 and the seal 459 limits the maximum movement of the rotor 415 away from the housing 410 and this can be varied as required. In addition, the spring constant may be varied to provide differing rates of compression of the spring 470 under the action of a pumped fluid.

Figure 10:
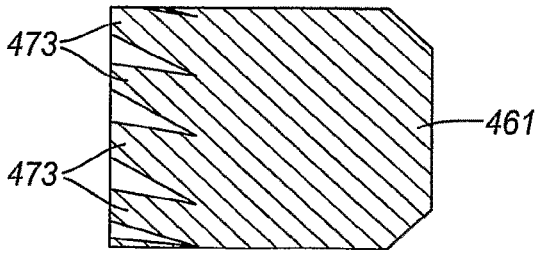
FIG. 10 is a side elevation of a cap with a serrated end for use as a spring in the embodiment of FIG. 9.

This spring force need not be provided by a coil spring 470 as shown in FIG. 9. Any suitable form of spring may be used such as a spring metal or a plastics washer. One possible variation is shown in FIG. 10. As seen in this Figure, the cap 461 is formed of a flexible material and is provided with a serrated open end so that each serration 473 can flex when compressed. The serrated open end of the cap 461 presses against the wall 472 of the seal 459 so that when the pressure of the rotor 415 increases as higher viscosity fluid is pumped through the pump, the serrations 473 flex to allow the spacing between the rotor 415 and the housing 410 to increase.

Figure 11:
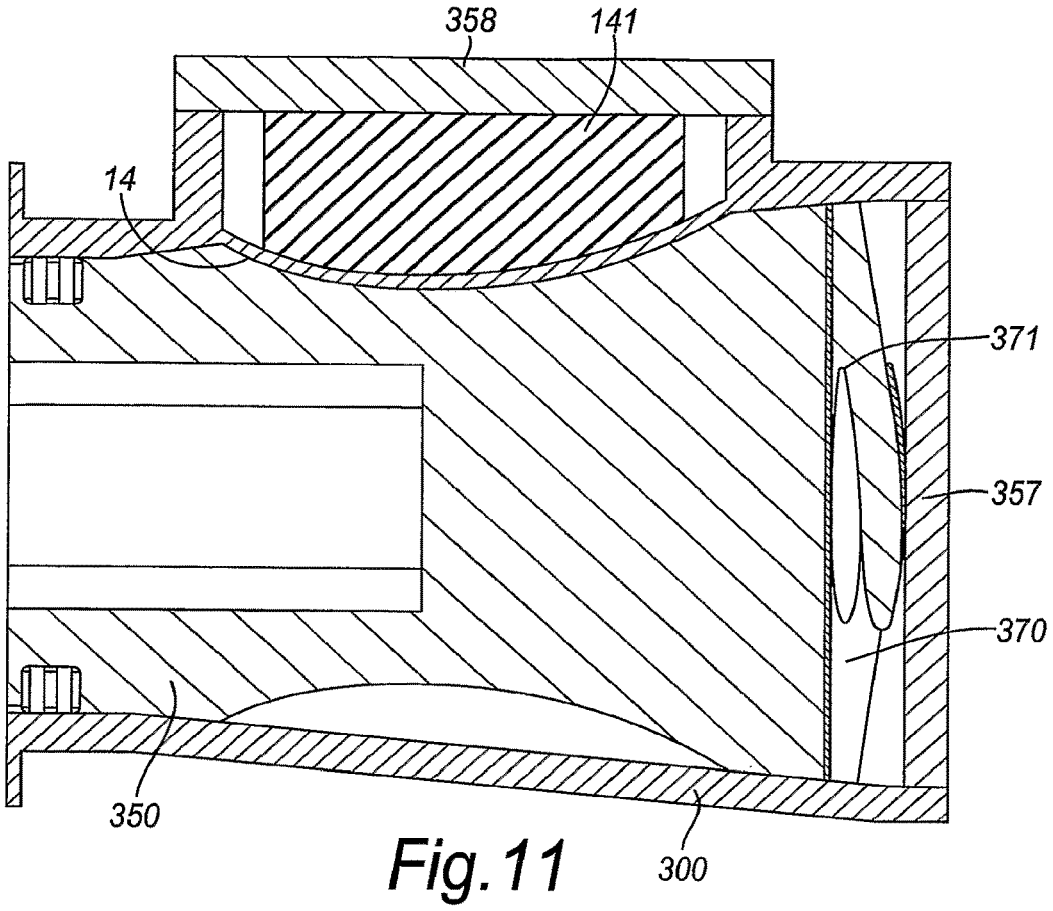
FIG. 11 is a similar view to FIG. 7 but showing the provision of a spring between the rotor and the housing at the larger diameter end of the rotor.
Figure 12:
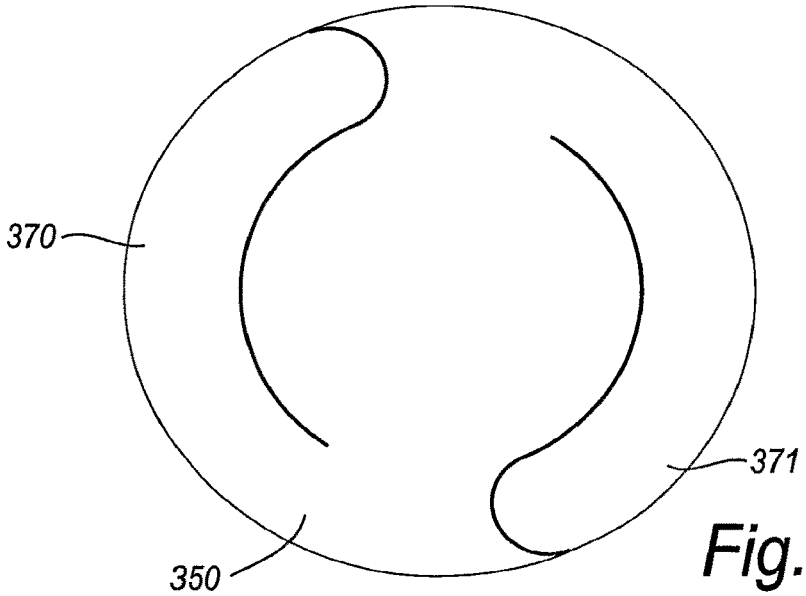
FIG. 12 is an end view of the rotor of FIG. 11.

A second variation is shown in FIGS. 11 and 12. In these Figures, the pump is constructed as described above with reference to FIG. 7 and parts common to that Figure and to FIGS. 11 and 12 are given the same reference numerals and are not described in detail.

Referring to FIGS. 11 and 12, the larger diameter end of the rotor 350 is formed with two arcuate cantilevered spring arms 370, 371 extending away from and around the larger diameter end. As seen in FIG. 11, the free ends of the spring arms 370, 371 bear against the washer 357 and provide a spring force urging the rotor 350 against the housing 300 and acting in the manner described above to allow priming of the pump with the rotor 350 close to the housing 300 followed by increased spacing as a higher viscosity liquid reaches the outlet.

The spring arms 370, 371 may be formed separately from the rotor 350. Where the rotor 350 is moulded, for example, the spring arms 370, 371 may be co-moulded with the rotor 350. A preferred material for such moulding is a polyacetal as it has a property of low creep. The benefit of a low creep spring is that it allows a range of viscosities to be pumped with one pump assembly.

Of course, the spring arms 370, 371 may be replaced by any other suitable form of spring acting between the rotor 350 and the housing 300, such as a coil spring or a spring washer.

In this embodiment, the range of movement is again limited by the spacing between the larger diameter end of the rotor 350 and the washer 357 and this can be adjusted or limited as required.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A pump comprising:

a housing having an interior defining a rotor path, and comprising a resilient seal, wherein the resilient seal and a remainder of the housing are formed in one piece and comprise a same material;

an inlet formed in the housing at a first position on said rotor path;

an outlet formed in the housing at a second position on said rotor path spaced from said first position;

a rotor rotatable in said housing, at least one first surface formed on the rotor and sealing against said rotor path of the housing, at least one second surface formed on said rotor circumferentially spaced from said at least one first surface and forming a chamber with the rotor path that travels around said rotor path on rotation of the rotor to convey fluid around the housing from the inlet to the outlet;

wherein the resilient seal is located on said rotor path and extending between the outlet and the inlet in a direction of rotation of said rotor;

wherein the at least one first surface seals with, and resiliently deforms, the resilient seal, as the rotor rotates around the rotor path within the housing to prevent the fluid flow from said outlet to said inlet past the resilient seal; and wherein the resilient seal is thinner than the remainder of the housing.

2. A pump according to claim 1, wherein the housing and the resilient seal are formed from a plastics material by a single injection molding process.

3. A pump according to claim 1, wherein the resilient seal is formed by a flexible plastics wall.

4. A pump according to claim 3, wherein the flexible plastics wall has a thickness of between 0.1 mm and 0.3 mm.

5. A pump according to claim 4, wherein the thickness of the flexible plastics wall is 0.15 mm.

6. A pump according to claim 4, wherein the flexible plastics wall is formed by an injection molding process using a hydraulic ram during an injection cycle to set the flexible plastics wall thickness of the resilient seal.

7. The pump according to claim 1, wherein the resilient seal is more flexible than the remainder of the housing.

8. The pump according to claim 1, wherein the rotor comprises at least two first surfaces formed on the rotor and sealed against said rotor path of the housing, each of the at least two first rotor surfaces sealing with and resiliently deforming the resilient seal as the rotor rotates around the rotor path within the housing, to prevent the fluid flow from said outlet to said inlet past the resilient seal.

9. The pump according to claim 1, wherein the interior of the housing defines a housing inner surface that defines the rotor path; the first and second positions being on the housing inner surface; the rotor including the at least one second surface recessed in the at least one first surface, the at least one second surface of the rotor forming the chamber with the housing inner surface; the at least one first surface of the rotor forming a fluid-tight seal around the at least one second surface.

10. The pump according to claim 9, wherein the housing inner surface defines a cylindrical rotor path and the at least one first surface of the rotor forms the fluid-tight seal with the cylindrical rotor path of the housing inner surface.

* * * * *